US012302972B1

(12) United States Patent
Li

(10) Patent No.: US 12,302,972 B1
(45) Date of Patent: May 20, 2025

(54) ARTIFICIAL EYELASH, METHOD FOR PREPARING SAME AND DEVICES THEREOF

(71) Applicant: Qingdao Baisi Yijia Cosmetics Co., Ltd, Qingdao (CN)

(72) Inventor: Kexiu Li, Qingdao (CN)

(73) Assignee: Qingdao Baisi Yijia Cosmetics Co., Ltd, Qingdao (CN)

( * ) Notice: Subject to any disclaimer, the term of this patent is extended or adjusted under 35 U.S.C. 154(b) by 0 days.

(21) Appl. No.: 18/900,763

(22) Filed: Sep. 29, 2024

(30) Foreign Application Priority Data

Sep. 20, 2024 (CN) ..... 202411317519.2

(51) Int. Cl.
*A41G 5/02* (2006.01)

(52) U.S. Cl.
CPC ..... *A41G 5/02* (2013.01)

(58) Field of Classification Search
CPC ..... A41G 5/02; A41G 5/008
See application file for complete search history.

(56) References Cited

U.S. PATENT DOCUMENTS

2022/0338585 A1* 10/2022 Chipman ..... A41G 5/02
2022/0386726 A1* 12/2022 Caulier ..... A41G 5/02

FOREIGN PATENT DOCUMENTS

| | | | |
|---|---|---|---|
| CN | 108366635 | A | 8/2018 |
| CN | 211747241 | U | 10/2020 |
| CN | 114727678 | A | 7/2022 |
| CN | 220494352 | U | 2/2024 |

* cited by examiner

*Primary Examiner* — Vishal I Patel

(57) ABSTRACT

The disclosure relates to the field of eyelashes processing technologies, specifically to an artificial eyelash and its preparation method and devices. The method includes S1 to obtain single piece eyelash extensions, S2 to obtain synthetic eyelash semi-finished product, S3 to initially cut off, S4 to stamp forming, S5 to roll up into fixed parts, S6 to heat with steam, S7 to apply adhesive and S8 to cut and shape. The disclosure utilizes the soaking liquid component attached to the finished eyelashes to provide a more comfortable wearing experience for the user.

25 Claims, 10 Drawing Sheets

ARTIFICIAL EYELASH, METHOD FOR PREPARING SAME AND DEVICES THEREOF

CROSS-REFERENCE TO RELATED APPLICATIONS

This application claims foreign priority of Chinese Patent Application No. 202411317519.2, filed on Sep. 20, 2024 in the China National Intellectual Property Administration, the disclosures of all of which are hereby incorporated by reference.

TECHNICAL FIELD

The invention related to the field of eyelash processing technologies, and more specifically, to an artificial eyelash, methods for preparing the eyelashes and devices thereof.

BACKGROUND ART

Artificial eyelashes have become increasingly popular among women thanks to their convenience and their aesthetic appeal, becoming an indispensable cosmetic item during makeup application. Manufacturing of artificial eyelashes requires accurate processing, and is generally made manually which includes the preparation of lash materials, creation of semi-finished products, curling and shaping, and trimming.

However, when users actually wear artificial eyelashes, they may experience discomfort and a globus sensation in the eyes. The main reason is that the glue residuals on the surface of the artificial eyelashes in the manufacturing process. Once liquid glue cured, its unevenness can easily irritate the user's eyes. Long term wear causes itchiness, discomfort, frequent blinking, and other issues over prolonged wear. Additionally, some individuals may simply be unaccustomed to wear artificial eyelashes, feeling a sense of foreignness or discomfort that can result in sore, tired eyes, and blurred vision. Further, during the processing of artificial eyelashes, the glue used to secure the lash band deforms in subsequent steps, affecting the comfort of wear and also contributing to a sensation of a foreign body when wearing the eyelashes.

SUMMARY

In order to remedy the shortcomings of the existing arts and solve the above technical problems, an artificial eyelash and a preparation method thereof are provided.

The first technical scheme discloses a method for preparing artificial eyelashes, which includes the steps as follows.

In the S1, eyelash extensions are placed in a lash mold causing them to be arranged in a desired pattern, and the arranged lashes are adhered to adhesive tape to maintain the arrangement and obtain a single piece eyelash.

In the S2, at least two of the single piece eyelashes are bonded together in a desired arrangement by a double-sided adhesive tape to form a semi-finished product of eyelashes.

In the S3, the semi-finished product of eyelashes is trimmed by cutting tools near the lower edge of the double-sided adhesive tape, and the upper part is retained for further processing.

In the S4, a preliminary pressing of the tip of the upper part of the eyelashes is performed through a stamping mechanism to curve the tips of the eyelash extensions.

In the S5, waterproof paper is laid flat on the workbench, and the eyelashes with curved tips are laid on the surface of the flat waterproof paper. The waterproof paper and the upper part of the eyelashes are wrapped around a shaping tube causing the eyelashes to curl around the tube, and the waterproof paper wrapped around the surface of the shaping tube is secured through a fixing rope or elastic band to obtain a shaping piece with the eyelashes encased between the waterproof paper and the shaping tube.

In the S6, the shaping pieces are placed into a steam pot for heating, that will cause the eyelash fibers to maintain a curled shape, and are then removed from the steam pot after heating to obtain curled eyelashes.

In the S7, the curled eyelashes are soaked in a first soaking solution (soaking solution a) and then arranged on a holding or assembly board. Glue is then applied on both sides of the curved eyelashes close to the root of the adhesive tape and along the entire length of the eyelash product in the direction of the tape.

In the S8, after applying the glue, the curled eyelashes with application of glue are placed in a ventilated environment under room temperature for drying. After the glue is dried, a blade is used to cut off the adhesive tape portion along the base of the eyelashes retaining a base portion attached only by the cured glue to obtain final eyelashes. The final eyelashes are then packaged for sale and shipping.

Preferably, in the S1, the eyelash fibers are arranged in the mold such that a cross angle between the length direction of the adhesive tape and the length direction of the lash extensions is 60-90° C.

Preferably, in the S1, the lash extensions include synthetic fiber lashes such as PBT, PET, PA, or natural lashes such as human hair or animal fur, or other types of lash fibers suitable for artificial eyelashes.

Preferably, in the S1, the lash mold includes but is not limited to lash distribution molds, lash distributors, etc. that can maintain the eyelash fibers in a desired orientation.

Preferably, in the S2, the lash extensions of each single piece eyelash are in contact with cross angle, and the extension of the two single piece eyelashes tilting to opposite directions when in contact and bonded.

Preferably, in the S2, the number of single lash pieces being bounded in the semi-finished product of eyelashes is at least two.

Preferably, in the S4, the stamping temperature of the stamping mechanism is in the range of 0-80° C. The stamping time is within 3-6 seconds, and the stamping force is within 5-10 N.

Preferably, in S5, the waterproof paper is moistened with a wetting liquid before being laid flat on the workbench.

Preferably, one edge of the waterproof paper remains dry, while the rest is moistened.

Preferably, the wetting liquid is a 0.6-0.9% sodium chloride solution.

Preferably, the shaping tube is initially rolled from the dry edge of the waterproof paper. The curved part of the eyelash tips is placed away from the dry edge direction of the waterproof paper.

Preferably, in the S5, the fixing rope includes elastic bands, elastic strings.

Preferably, in the S6, the rolled up eyelash shaping piece is sealed inside a plastic bag before being placed into the steam pot.

Preferably, in the S6, the operating temperature of the steam pot is controlled between 60-78° C., and the operating time is between 14-16 minutes.

Preferably, in the S7, the glue is applied on both sides of the curved eyelashes about 1-2 mm away from the top of the adhesive tape, thus forming stemless eyelash extensions.

Preferably, in the S7, two stems are placed on both sides of the curved eyelashes above the adhesive tape, and the two stems are bonded with the base of the curved eyelashes by glue to form double-stem eyelashes.

Preferably, in the S7, a single stem is positioned on one side of the curved eyelashes above the adhesive tape, and the single stem is bonded with the curved eyelashes by glue to form single-stem eyelashes.

Preferably, the curved eyelashes can also be bonded with more than two stems.

Preferably, the stem has been soaked in a second soaking solution (soaking solution b) before use.

Preferably, the soaking solution a is at least one of VE solution or sodium hyaluronate solution.

Preferably, the soaking solution b is at least one of VE solution or sodium hyaluronate solution.

Preferably, the soaking time of the curved eyelashes in soaking solution a is 6-12 hours, and the soaking temperature is 3-5° C.

Preferably, the soaking time of the stem in soaking solution b is 6-12 hours, and the soaking temperature is 15-30° C.

Preferably, when bonding the curved eyelashes with two stem using the glue, the steps are performed as follows.

Step A: a first stem is positioned on the assembly board, and the curved eyelashes are placed on top of the first stem such that the first stem is positioned approximately 1-2 mm away from the upper edge of the adhesive tape.

Step B: a second stem is placed on top of the curved eyelashes, so that the two stems are distributed on both sides of the curved eyelashes and similarly positioned approximately 1-2 mm away from the upper edge of the adhesive tape, with the distance between the first and second stem being approximately 0.01-0.5 mm.

Step C: a glue applicator is used to evenly apply glue along the length of the first and second stems, and on both sides of the curved eyelashes respectively to obtain double-stem eyelashes.

Preferably, when bonding the curved eyelashes with a single stem using the glue, the following steps are performed.

Step a: a stem is positioned on the assembly board and the curved eyelashes are placed on top of the stem. The stem is positioned to be approximately 1-2 mm away from the upper edge of the adhesive tape.

Step b: a glue applicator is used to evenly apply glue along the length of the stem, and on both sides of the curved eyelashes respectively to obtain single-stem eyelashes.

Preferably, the color of the stem is colorless or colored.

Preferably, in the S8, the drying time is 5-7 days, and during the drying process, the curved eyelashes are sprayed with soaking solution a.

Preferably, during the drying process of the curved eyelashes, the stem is sprayed with soaking solution b.

A system for preparing artificial eyelashes is provided, which is suitable for the method of preparing artificial eyelashes as disclosed above. The system includes a lash extension separation mold, a stamping forming machine, a steam pot, a wire bonding plate, and a glue applicator. The lash extension separation mold includes a mold body and a mold cover; a front side of the mold body is provided with two loading slots. An upper surface of the mold body is provided with a lash extension separation groove. The lash extension separation groove runs through the corresponding loading groove. A rear side of the lash extension separation groove is arc-shaped. The lash extension separation groove is provided with lash extension separation pieces at intervals. A lash extension gap is formed between adjacent lash extension separation pieces. An upper surface of the mold body is provided with a strip-shaped adhesive groove. A 60-90 degree intersection angle is formed between the adhesive groove and the lash extension separation pieces. The intersection angle can be within 30-60 degree range, 0-30 degree range or any suitable range. The loading box is connected to the loading slot in a sealing manner. The loading box is provided with placement slots that run through the top and bottom; a cross-section of the placement slot is the same as and corresponds to the position of the lash extension separation groove. An inner wall of the placement slot is slidably up and down to seal and connect with the placement plate; and the loading slot is provided with an operating slot that runs through the lower inner wall.

Preferably, the vertical outer wall of the placement plate is provided with a groove. The groove is slidably connected to a block; the block is connected to the groove bottom through a spring; the block is inclined upwards at one end away from the spring and has a guiding surface. An inner wall of the placement slot is vertically provided with multiple slots. The slot opening is compatible with the groove opening. The groove aligns with the corresponding slot as the placement board moves up. The block can be inserted into the corresponding slot at one end away from the spring.

Preferably, the slot is set on the lateral inner wall of the placement slot.

Preferably, an elastic sponge is provided in the slot; the elastic sponge can be compressed towards the bottom of the slot under the pressure of the block; the elastic sponge fills the corresponding slot after the block is moved away. Other types of suitable filler material can be used here as well, including but not limited to, elastic rubber or plastic.

Preferably, a hemispherical elastic protrusion is fixedly attached to the surface of the loading box; the loading slot is provided with a concave groove corresponding to the elastic protrusion on the upper slot wall; the elastic protrusion is inserted into the concave groove as the loading box enters the loading slot; and a front side of the loading box is fixedly connected to the box handle.

Preferably, the groove is provided with a push groove that runs downward through the lower groove wall. The movable connecting middle block in the slot. A cross-sectional shape of the block is L-shaped; the upper end of the push block is fixedly connected to the block.

Preferably, the lateral side of the mold body is provided with a sliding rail; the mold cover is connected to the sliding rail through sliding edge strips; a lower surface of the mold cover is in contact with the upper surface of the mold body.

Preferably, the lower surface of the mold cover is provided with an avoidance groove; the avoidance groove runs through the front side of the mold cover; the avoidance groove is fixedly connected to an elastic piece on the rear inner wall; the elastic piece is L-shaped; the elastic piece extends towards the front side and covers the front side of the avoidance groove; the elastic piece is fixedly connected to a buckle block at the upper end; the lower surface of the elastic piece in the initial state is in contact with the upper surface of the mold body.

Also disclosed are eyelashes that are formed by the devices and the methods as disclosed above.

The beneficial effects are:

By using wetting liquid to sterilize and disinfect the upper half of the eyelashes during steam heating, and by using the soaking solution components attached to the finished eyelashes, the eyelashes become more comfortable to for users and symptoms such as eye soreness, fatigue, and blurred vision can be avoided.

Since the base is glued (with or without stems) after high-temperature steam heating in this invention, the undesirable aesthetic effect of the transparent glue turning white during the steam pot process it is avoided improving the quality of eyelash stem transparency and making the produced eyelashes more transparent and aesthetically pleasing.

Since the stem(s) is glued after rolling with a shaping tube in this invention, the process also avoids the negative effects in existing artificial eyelash production methods where black glue on the base stem(s) becomes sticky due to pressure from the rolling tube, sometimes causing paper fluff residue to remain on the black eyelash stem, rendering it unwearable.

This invention places eyelash extensions into a placement slot aligned with a furcation slot, allowing the mold body to complete separation of eyelash extensions into furcation gaps during tilting and inverting, preparing for subsequent adhesion of bonding components to pick up eyelash extensions, greatly improving manufacturing efficiency compared to manually adding eyelash extensions into furcation slots one by one, and facilitating use.

This invention places eyelash extensions into a placement slot aligned with a furcation slot, allowing the mold body to complete separation of eyelash extensions into furcation gaps during tilting and inverting, preparing for subsequent adhesion of bonding components to pick up eyelash extensions, greatly improving manufacturing efficiency compared to manually adding eyelash extensions into furcation slots one by one, and facilitating use.

BRIEF DESCRIPTION OF THE DRAWINGS

The following further describes the invention in conjunction with the attached figures and embodiments.

Figure 1:
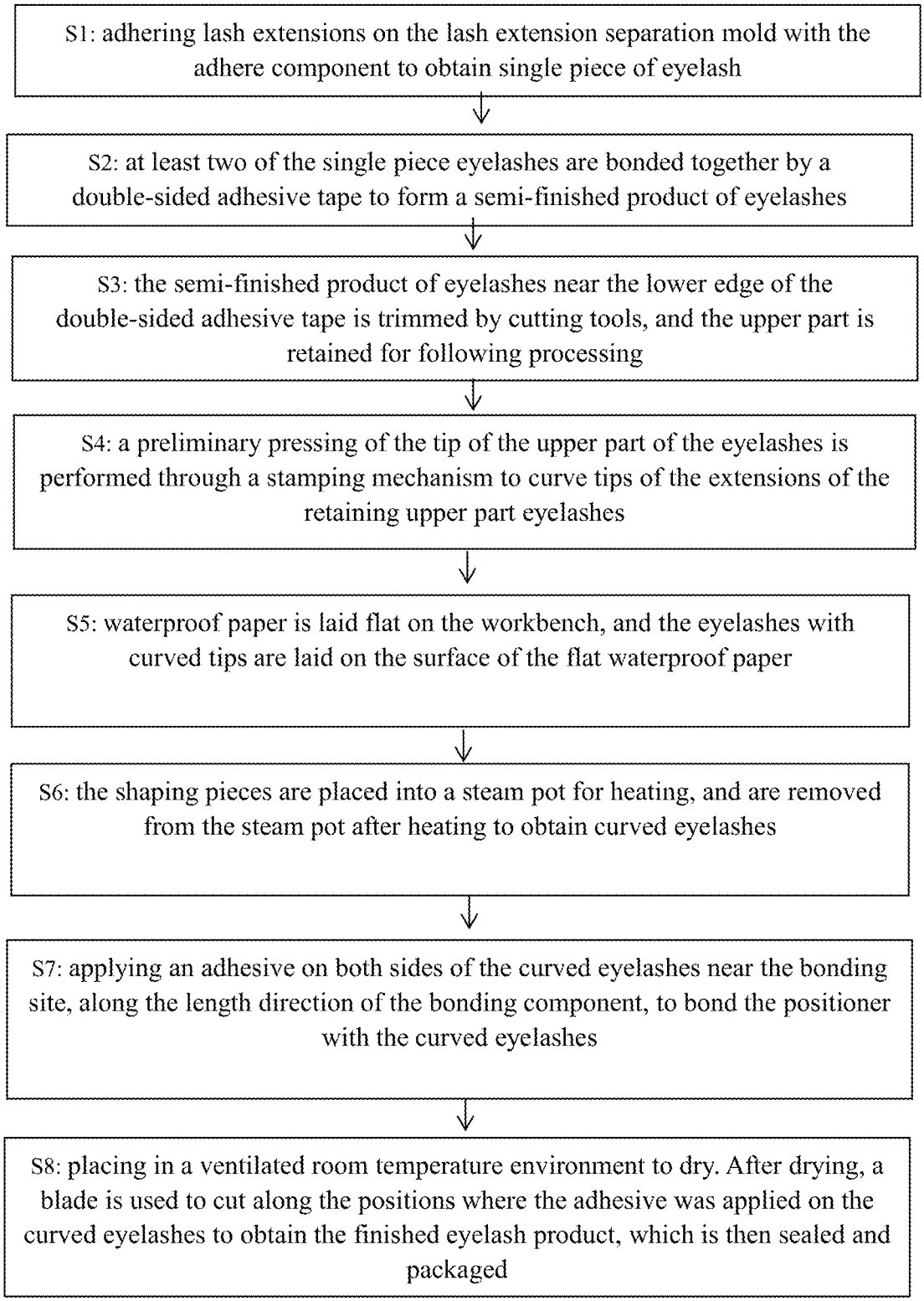
FIG. 1 is a flowchart of the preparation method of the disclosure.
Figure 2:
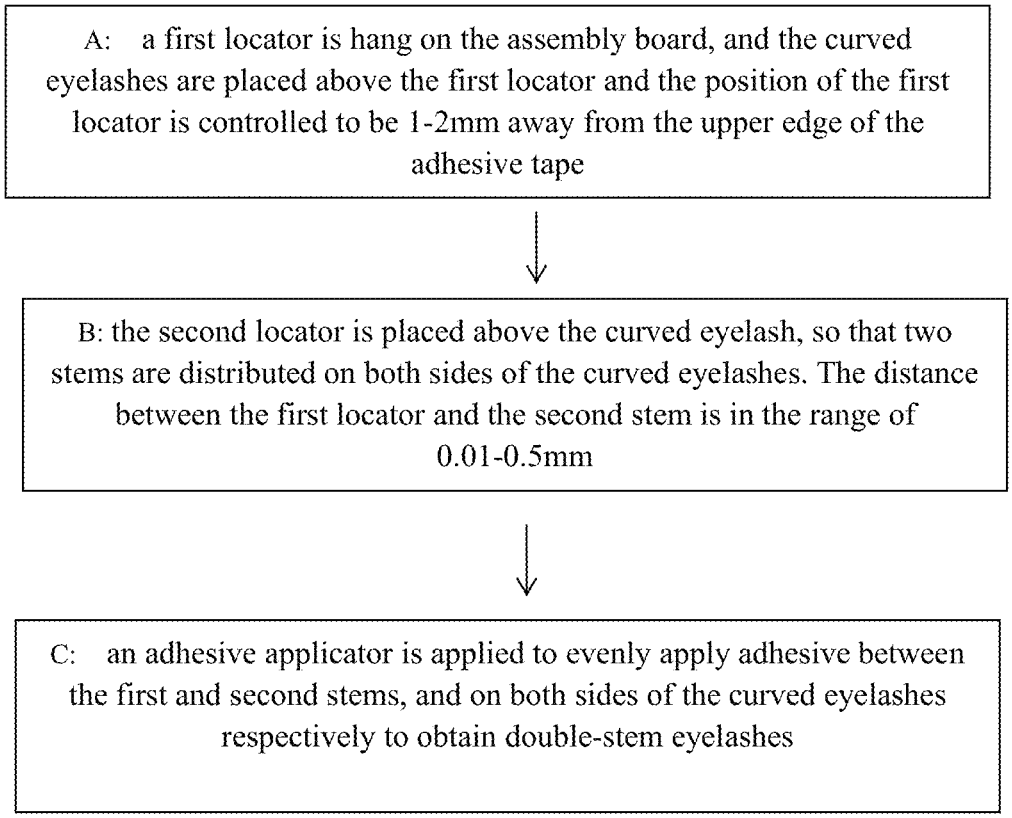
FIG. 2 is a flowchart of the double stem eyelash bonding process in the disclosure.
Figure 3:
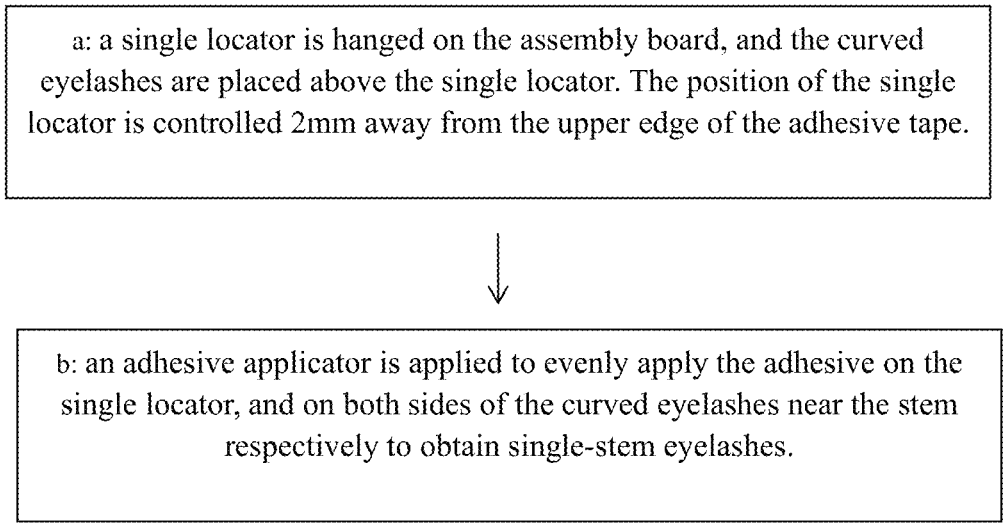
FIG. 3 is a flowchart of the single stem eyelash bonding process in the disclosure.
Figure 4:
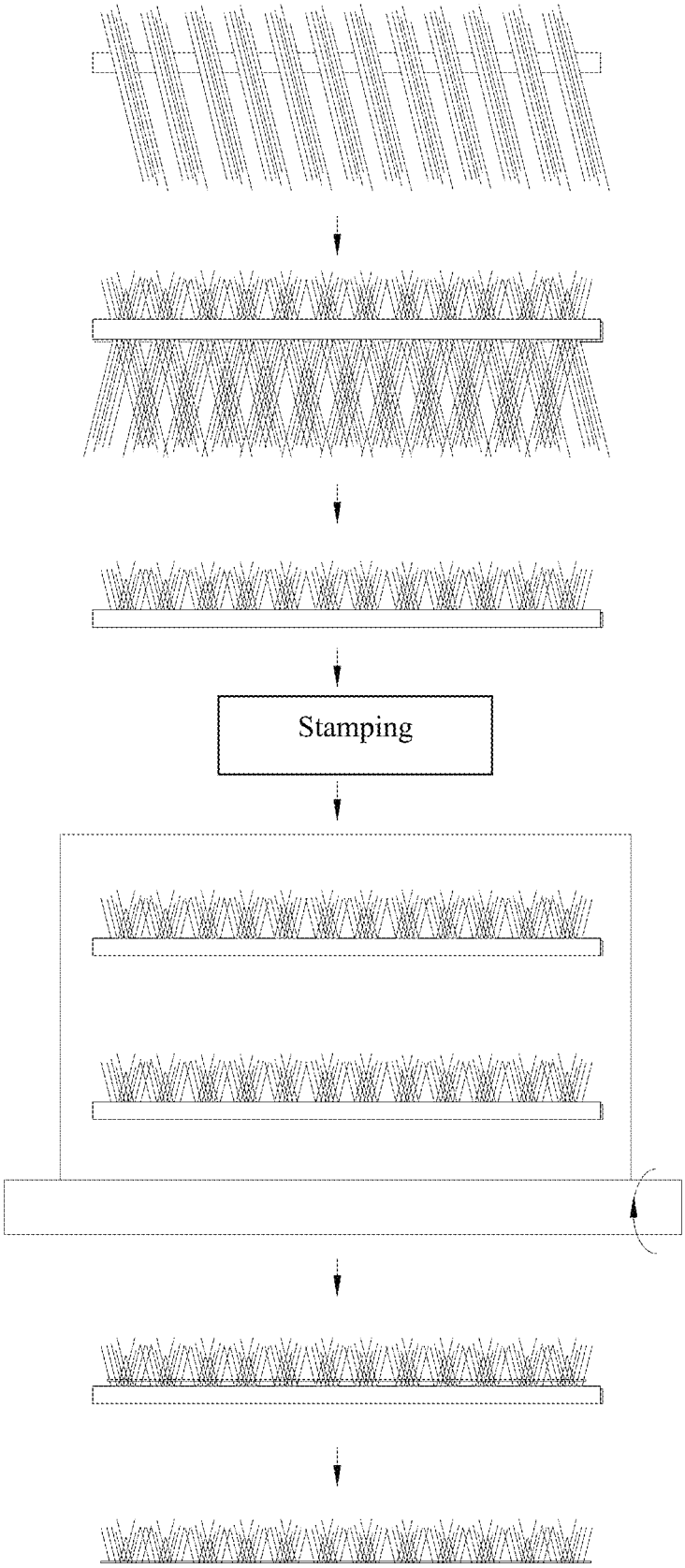
FIG. 4 is a schematic diagram of eyelash preparation in the disclosure.

In the drawings: Mold body 1, loading slot 11, lash extension separation groove 12, lash extension separation piece 13, gap 14, adhesive slot 15, operation slot 16, pit 17, sliding track 18, mold cover 2, edge strip 21, avoidance slot 22, elastic piece 23, buckle block 24, loading box 3, placement slot 31, slot 32, elastic sponge 33, elastic protrusion 34, placement plate 4, groove 41, push slot 42, spring 43, push block 44, clamp block 5, guide surface 51.

DETAILED DESCRIPTION OF THE EMBODIMENTS

To facilitate a clear understanding of the technical means, creative features, objectives, and effects achieved by the disclosure, the following further elaborates on this invention in conjunction with specific implementation methods.

A method for preparing artificial eyelashes is disclosed, which includes the steps as follows.

S1: adhering the eyelash extensions on the eyelash separation mold to the temporary bonding component to obtain a single piece eyelash extension.

In some embodiments, the temporary bonding components used in the S1 include but are not limited to transparent tape, colored tape, green high-temperature tape, and color-blocked tape. The bonding components can be other suitable adhesive material, including but not limited to liquid glue or gum. When using transparent tape, the distribution of eyelash extensions on the tape can be seen more clearly, which is convenient for operators to observe whether the eyelash extensions are evenly distributed on the eyelash separation mold. This is beneficial for improving the processing quality in the early stages of artificial eyelash preparation and facilitating subsequent steps in the process.

Furthermore, when using colored tape, it is more noticeable. Operators can better position the eyelash extensions when adhering them with colored tape, allowing for clearer observation of any wrinkles that may appear on the surface of the colored tape during the adhesion process. This avoids the phenomenon of multi-layer stacking of eyelash extensions on the eyelash separation mold, which could lead to a decrease in the yield rate of good products in subsequent artificial eyelash preparation.

Moreover, when using green high-temperature tape, there is no need to worry about residual glue remaining on the surface of the green high-temperature tape causing harm to the human eye. The green high-temperature tape is made from a green material that is non-toxic, harmless, and odorless, posing no harm to humans or the environment. Additionally, green high-temperature tape has heat-resistant properties and can maintain stable performance in extreme high-temperature environments without deformation or damage due to temperature rise. This is advantageous for expanding the preparation pathways of artificial eyelashes since they are not restricted by temperature. Within the working temperature range of green high-temperature tape, artificial eyelash preparation can proceed unhindered.

At the same time, when using color-blocked tape, it is possible to better position the eyelash extensions that need to be cut later. For example, when adhering eyelash extensions with tape that has a dual color combination of blue and white, the color-blocked tape is first adhered to the corresponding positions of the eyelash extensions. Then, during the cutting process, the eyelash extensions can be cut along the junction of the blue and white colors. At this point, the junction of the color-blocked tape acts as a positioning line for the cutting of the eyelash extensions, thereby improving the precision of subsequent eyelash positioning and enhancing the quality of artificial eyelash processing.

It should be noted that the temporary bonding components mentioned in this invention are not limited to various types of tape. For example, starch paste made from wheat starch can also be used. Specifically, when using it, first apply the paste on a paper with adhesive properties, then adhere the paper coated with the paste to the eyelash extensions on the eyelash separation mold. In this case, the temporary bonding component is "the paper coated with paste", however, its use must take into account the temperature at which the paste loses effectiveness.

In some embodiments, the eyelash separation mold in S1 can also be specifically customized according to the shape required by the actual artificial eyelashes, besides the specific structure defined by this invention. Specifically, the eyelash separation mold refers to a board with one or more grooves cut into it, where eyelash extensions are evenly distributed in the grooves. Then, a bonding component is used to adhere to the board, sticking the eyelash extensions on the surface of the grooves. Currently, most grooves in existing arts have a semicircular cross-section, but the cross-section of the grooves in this invention can also be other shapes, such as trapezoidal with a narrow top and wide bottom, and a micro lifting structure, such as a combination of a micro cylinder and a top plate, is set at the bottom of the groove. Due to the reason of being narrow at the top and wide at the bottom, when the eyelash extensions are evenly distributed in the groove and fill the groove, the eyelash extensions at the top of the groove are more concentrated, making it easier for the bonding component to adhere and allowing for a denser adhesion of eyelash extensions in one go. This results in a greater variety of artificial eyelashes prepared subsequently, suitable for more consumer groups.

In the process of adhering eyelash extensions with a temporary bonding component S1, it is not strictly necessary to use a eyelash separation mold. eyelash extensions of the same or different lengths can also be manually selected and then clamped onto the bonding component with tweezers or other clamping tools for arrangement and adhesion, which can also achieve the purpose and effect intended in S1.

In the S2, multiple pieces of single eyelash extensions are bonded together by temporary adhesive tapes to form a semi-finished eyelash product.

Specifically, the bonding strips used in step S2 include but are not limited to double-sided tape, adhesives, etc. Among them, double-sided tape can use double-faced fabric tape, which is made of tearable gauze as the base material, coated with high viscosity hot melt adhesive or natural rubber, and compounded with double-sided release paper. It has a large tensile strength, strong adhesion, high peeling force, leaves no residue, and there is no need to worry about glue residue on the prepared artificial eyelashes.

At the same time, silicone double-sided tape can also be used, which is a product using environmentally friendly silicone as an adhesive, it has good stickiness but does not leave adhesive marks.

Or, acrylic double-sided tape is being used, which is a product made purely of glue. When using it, just stick the double-sided tape on the item and press lightly to securely stick it without leaving any adhesive marks.

Of course, an adhesive can also be directly used, applying it to one of the lash extension pieces that needs to be in contact, then pressing it by hand or machine to adhere the lash extension pieces that need to be in contact together to form a semi-finished eyelash product. The adhesives include natural rubber glue, carboxymethyl cellulose glue, etc., all of which are harmless to the human body, but selection should take into account the temperature during the preparation of artificial eyelashes to avoid the adhesive failing due to low or high temperatures.

Furthermore, the lash extension pieces used in step S2 are at least two, and the arrangement for contact adhesion of the lash extension pieces depends on the shape required for the artificial eyelashes.

In some embodiments, if the desired shape of the artificial eyelashes is "swallowtail", then cross the lash extensions on two lash extension pieces so that they touch each other with opposite tilt directions.

In some examples, if the desired shape of the artificial eyelashes is "dense", then cross the lash extensions on two or more lash extension pieces, or have them touch in the same direction for adhesion.

In some examples, if the desired shape of the artificial eyelashes is "single fairy", then have the lash extensions on two or more lash extension pieces touch in the same direction for adhesion.

That is to say, the shapes of artificial eyelashes can be obtained by different arrangements according to the above methods of this invention. This invention is not limited to obtaining the aforementioned concentrated shapes of artificial eyelashes. Other shapes of artificial eyelashes can also be obtained by using the methods defined in this invention with different combinations of arrangements, such as dense sandwich, single cluster, etc., all of which are within the scope of protection of this invention.

In the S3, a cutting tool is applied to cut off the lower edge of the semi-finished eyelash product near the adhesive tape, retaining the upper half of the eyelashes with adhesive tape.

Among them, the cutting tools in step S3 include manual cutting knives, semi-automatic cutting knives, and automatic cutting knives. This invention does not limit the use of a specific cutting tool, as long as it can complete the cutting requirements of the eyelash semi-finished product. However, it should be noted that different shapes of artificial eyelashes can be obtained in step S2, so when selecting cutting tools, appropriate cutting tools can be selected according to the shape, quantity, density, etc. of the eyelash semi-finished product.

In the S4, a preliminary stamping is performed on the tip of the eyelashes of the retained upper half of the eyelashes or the retained lower half through a stamping mechanism to obtain the upper half of the eyelashes with curved tips. Platform of the stamping mechanism is installed with positioning grooves for curving the tips of the eyelash extensions. The positioning grooves are used in conjunction with contact pieces touching the tips of the eyelash extensions to stamp and curl the eyelash extensions into shape.

Specifically, the method for curling and shaping the tips of the lash extensions in step S4 is mechanical stamping, which employs a method involving contact between positioning grooves and contact pieces. The shapes of the positioning grooves and contact pieces are designed according to the desired curvature of the lash extension tips. For example, using semicircular positioning grooves and contact pieces can achieve lash extension tips that curve in an arc shape;

Alternatively, polygonal positioning grooves and contact pieces, such as quadrilateral or hexagonal shapes, can be used to obtain lash extension tips with multiple curved segments, enhancing the applicability range of the prepared artificial eyelashes;

Furthermore, using polygonal positioning grooves and contact pieces with different side lengths can result in lash extension tips with multiple curved segments of varying lengths, also expanding the applicability range of the prepared artificial eyelashes.

Of course, in step S4, a shaping agent can also be used to obtain the upper part of the lash with curved tips, such as using antibacterial and mold-resistant shaping agents, natural starch, modified starch, etc. The advantage of this method is that there is no need for reheating the already curved upper part of the lash, reducing the cost of preparing artificial eyelashes;

Similarly, in step S1, special shaped lash extensions can be used, such as metal wires coated or impregnated with lash extension raw materials. By utilizing the direct bending and shaping characteristics of metal wires, step S4 can be omitted, further simplifying the preparation process. Metal wires made from memory metal can be selected, which can deform and bend within the range of human body temperature. When wearing artificial eyelashes containing memory metal lash extensions, they can deform and bend according to the temperature of the human body, achieving better wearing effects.

In the S5, after laying waterproof paper flat on the worktable, the upper half of the eyelashes are laid flat with curved tips on the surface of the waterproof paper. The waterproof paper and the upper half of the eyelashes are wrapped around a shaping tube and is secured by a fixing rope to obtained a shaped piece that encases the upper half of the eyelashes with curved tips between the waterproof paper and the shaping tube. The shaping tube is used to maintain the shape of the already formed eyelash extensions, facilitating the retention of the stamped and curled form during later processes. The obtained upper part of the lash with curved tips is encased between waterproof paper and a shaping tube. It should be noted that if the shaping agent used in step S4 of this invention is selected, then the use of a shaping tube and waterproof paper can be omitted. The use of a shaping agent can directly achieve the curved shape of the artificial eyelashes, or using lash extensions containing memory metal also eliminates the need for waterproof paper and a shaping tube.

In the S6, the shaped pieces are placed into a steam pot to complete heating, and are removed after heating to obtain shaped curved eyelashes. Specific implementation, if the shape of the stamped and formed extensions is good, the step of heating can be omitted. The necessity of the steps is no strictly limited.

Similarly, if the shaping agent used in step S4 of this invention is selected, then the use of a steam pot can be omitted. The use of a shaping agent can directly achieve the curved shape of the artificial eyelashes, or using lash extensions containing memory metal also eliminates the need for a steam pot, further reducing preparation steps and improving the cost efficiency of artificial eyelash processing. Of course, if step S6 is used in this invention, it is not limited to using a steam pot; steam boxes and other equipment can also be utilized.

S7: After soaking the curved eyelashes in immersion solution a, remove them and apply an adhesive on both sides of the curved eyelashes near the bonding site, along the length direction of the bonding component, to bond the stem with the curved eyelashes;

Specifically, the bonding components used in S7 include glue, which is a common method in existing technology. In other implementations of this invention, tape, film, etc., can also be used. Additionally, bonding components made from natural starch or modified starch can be utilized. Since there is no need to use heating equipment for heating the curled eyelashes containing the positioner in step S8 of this invention, there is no concern about the subsequent failure of bonding components containing natural starch or modified starch.

Furthermore, in the general methods of existing technology, the positioner is often a wire stem, such as black thick hard stem, black fine hard stem, cotton thread stem, and transparent stem, etc. However, this invention is not limited to using the above-mentioned types of wire stems as positioners. Therefore, this invention is also not limited to using bonding components to bond the positioner with the curved eyelashes, that is:

In some examples, the positioner in S7 includes memory metal wires, which are fixed to the curved eyelashes using thread and fabric, such as by sewing machines, hook needles, and knotting, etc. This method results in better integration of the positioner with the curved eyelashes, making it less likely for the lash extensions on the curved eyelashes to fall off from the positioner. Moreover, using memory metal wires allows them to bend according to body temperature, making them more fitting to the human eye after bending and improving the comfort of wearing artificial eyelashes.

In some examples, the method of connecting the positioner with the curved eyelashes in S7 includes hot melting, where the positioner is heated, or the end of the curved eyelashes that comes into contact with the positioner is heated. By utilizing the property of materials to adhere to each other after heating, they are bonded together. This method can avoid leaving adhesive residue on the surface of the artificial eyelashes, affecting their appearance during subsequent use.

Of course, in some examples, the positioner includes bendable metal wires, bendable wire stems, and transparent stems, etc., with one or more micropores opened on their surface. The curved eyelashes are inserted into the micropores to fix them with the positioner in a card connection manner to obtain the finished eyelash product. To ensure the stability of the card connection between the curved eyelashes and the positioner, one or more lash clusters can be filled into the micropores to closely fit the lash clusters with the micropores, improving the stability of the card connection. Of course, if this method is used, preparing the positioner and lash extension materials directly is sufficient, shortening the overall preparation process, reducing production line costs, and the overall shape of the micropores on the surface of the positioner is designed according to the required shape of the artificial eyelashes as a whole, such as swallowtail shapes, etc., as well as carding different lengths and types of lash extensions to obtain artificial eyelashes of different shapes.

It should be noted that this preparation method needs to be carried out in an enlarged environment, such as using magnifying glasses and other equipment.

S8: The curved eyelashes containing the positioner, after being coated with adhesive, are placed in a ventilated room temperature environment to dry. After drying, a blade is used to cut along the positions where the adhesive was applied on the curved eyelashes to obtain the finished eyelash product, which is then sealed and packaged.

In this example, the length direction of the bonding component in S1 forms a cross angle of 60-90° C. with the length direction of the lash extensions; The lash extensions in S1 include synthetic fibers such as PBT, PET, PA, etc., or natural hairs such as human hair or animal fur, etc., or other types of hairs that can be used as lash extensions. Of course, this also includes other types of lash extensions specified in this invention.

In this embodiment, in the S4, the stamping temperature of the stamping mechanism is in the range of 0-80° C. The stamping time is controlled within 3-6 seconds, and the stamping force is controlled at 5-10 N.

In this embodiment, in the S5, before laying flat on the worktable, the waterproof paper requires to be moistened with a wetting solution.

In this embodiment, one edge of the waterproof paper remains dry while the remaining part is moistened.

In this embodiment, the wetting solution is a 0.9% sodium chloride solution.

In this embodiment, in the S5, the shaping tube is initially rolled from the dry edge of the waterproof paper. The curved part of the eyelash tips is placed away from the dry edge direction of the waterproof paper.

In this embodiment, in the S5, the fixing rope includes elastic bands, bungee cords, etc.

In this embodiment, in the S6, the shaped piece requires to be sealed in a plastic bag before being placed in the steam pot.

In this embodiment, in the S6, the operating temperature of the steam pot is controlled between 60-78° C., and the operating time is 14-16 minutes.

In this embodiment, in the S7, the distance between both sides of the curved eyelashes where glue is applied is 2 mm from the adhesive tape, forming stemless eyelashes.

In this embodiment, in the S7, stems are placed on both sides of the curved eyelashes, and then adhesive is applied to bond the two stems with the curved eyelashes, forming double-stem eyelashes.

In this embodiment, in the S7, a single stem is placed on one side of the curved eyelashes, and then adhesive is applied to bond the single stem with the curved eyelashes, forming single-stem eyelashes.

In this embodiment, in the S7, the curved eyelashes can also be bonded with two or more stems.

In this embodiment, the stem has been soaked in soaking solution b before use.

In this embodiment, the soaking solution a is a VE solution or sodium hyaluronate solution, either alone or in combination.

In this embodiment, the soaking solution b is a VE solution or sodium hyaluronate solution, either alone or in combination.

In this embodiment, the curved eyelashes are soaked in soaking solution a for 6-12 hours, with a soaking temperature of 3-5° C.

In this embodiment, the stem is soaked in soaking solution b for 6-12 hours, with a soaking temperature of 15-30° C.

In this embodiment, when adhesive is applied to bond the curved eyelashes with the stem, the following steps are performed.

A: the first locator is hanged on the assembly board, and the curved eyelashes are placed above the first locator, and the position of the first locator is controlled 2 mm away from the upper edge of the tape. In practical implementations, the locator can be stems or other devices for positioning.

B: the second locator is placed above the curved eyelash, so that two stems are distributed on both sides of the curved eyelashes. The distance between the first locator and the second stem is in the range of 0.01-0.5 mm.

C: an adhesive applicator is applied to evenly apply adhesive between the first and second stems, and on both sides of the curved eyelashes respectively to obtain double-stem eyelashes.

In some implementations, when the adhesive is applied to bond the curved eyelashes with the stem, the following steps are performed.

a: a single locator is hanged on the assembly board, and the curved eyelashes are placed above the single locator. The position of the single locator is controlled 2 mm away from the upper edge of the adhesive tape.

b: an adhesive applicator is applied to evenly apply the adhesive on the single locator, and on both sides of the curved eyelashes near the stem respectively to obtain single-stem eyelashes.

In some implementations, the color of the stem can be either colorless or colored.

In some implementations, in the S8, the drying time is 5-7 days, and during the drying process, the soaking solution a is sprayed on the curved eyelashes.

In some implementations, during the drying process of the curved eyelashes, the soaking solution b is sprayed on the stem.

The disclosure provides a method for preparing artificial eyelashes as described below. Of course, the disclosure can also use any of the preparation methods described in the specification to obtain artificial eyelashes, and these methods have already been disclosed in the specification and are not limited to the following methods.

Firstly, the lash extensions is placed on a lash extension separation mold, then attach the bonding component at an oblique angle on the lash extension separation mold where it comes into contact with the lash extensions, such that the length direction of the bonding component forms a 70-degree cross angle with the lash extensions. As the bonding component is removed, the lash extensions are pulled out from the lash extension separation mold along with the removal of the bonding component, thus obtaining single piece lash extension. Then, place one of the single piece lash extensions on a workbench with the bonding component of the single piece lash extension located directly below the lash extensions. Subsequently, stick a strip-shaped adhesive tape onto the lash extensions, peel off the cotton paper on the surface of the adhesive tape, and adhere another single piece lash extension onto the adhesive tape, ensuring that the lash extensions on both single piece lash extensions are bonded towards each other through the adhesive tape. Next, cutting off the semi-finished eyelash near the lower edge of the bonding component with a cutting tool, retaining the upper half of the eyelash with the bonding component. The tip part of the said upper half of the eyelash is preliminarily hot-stamped by a stamping machine to obtain the upper half of the eyelash with curved tips;

During the operation of the stamping machine, the temperature of the stamping machine is set to 80° C. with the stamping time controlled at 5 seconds and the stamping force at 10 N. Then, removing one edge of the waterproof paper and place the rest in a 0.9% sodium chloride solution (i.e., wetting solution) to wet the waterproof paper. The wet waterproof paper will be laid flat more obediently on the workbench. The upper half of the eyelash with curved tips is laid flat on the surface of the waterproof paper, ensuring that the curved tip part of the upper half of the eyelash is placed away from the dry edge direction of the waterproof paper. A shaping tube is used to roll up the waterproof paper and the upper half of the eyelash, starting from the dry edge of the waterproof paper, and secure the waterproof paper rolled around the surface of the shaping tube with a fixing rope, obtaining a shaped piece with the upper half of the eyelash encased between the waterproof paper and the shaping tube. The shaped piece is placed in a steam pot for heating, with the steam pot temperature set to 70° C. and a running time of 15 minutes. The wetting solution can sterilize and disinfect the upper half of the eyelash inside a sealed plastic bag. The steam pot is opened to retrieve the shaped piece, obtaining curved eyelashes.

Prepare soaking solution a, and control the soaking time of the curved eyelashes in soaking solution a to 6 minutes at a temperature of 4° C. before removing them. Then, depending on the selected requirements, choose between production without a positioner and with a positioner assist. For curved eyelashes without a positioner, simply apply an adhesive on both sides of the curved eyelashes near the bonding component, 2 mm apart along the length direction of the bonding component, to form eyelashes without a positioner. For eyelashes with a positioner, combine with an adhesive glued 2 mm away from the bonding component. The two lines of a double positioner eyelash are spaced 0.5 mm apart. The positioner is soaked in soaking solution b for 6 hours at a temperature of 15° C. before use, allowing the positioner and curved eyelashes to bond together after being soaked in their respective solutions. Finally, air-dry under ventilated conditions. During the drying process, spray the corresponding curved eyelashes and positioners with soaking solutions a and b to ensure that the effective ingredients in soaking solutions a and b adhere to the curved eyelashes and positioners. After drying, use a blade to cut along the positioner or near the bonding component to create eyelashes with or without stems, followed by sealing and packaging.

The purpose of sealing and packaging is to reduce the loss of soaking solutions a and b in the natural environment, ensuring the actual application effect of the artificial eyelashes. Sealing methods include vacuum sealing, inert gas filling, etc.

It should be noted that the way of obtaining the stamping temperature of the stamping forming machine is generally to set up an electric heating wire or other heating parts on the positioning groove and the stamping component, etc., to heat the positioning groove and the stamping component, and then heat the tips of the eyelashes, so as to facilitate the bending during stamping. That is, in the disclosure, the working temperature of the positioning groove and the stamping component in the stamping forming machine is in the range of 0-80° C., that is, the disclosure can choose to heat the positioning groove and the stamping component during stamping, It is also possible not to heat the positioning groove and the stamping component during stamping, whether it is heated can be decided according to the raw material of the eyelash extensions, such as the raw material of the eyelash extensions is PBT material, the raw material of the eyelash extensions of this material is stable warp and heat resistance, in order to avoid damaging its characteristics and structure when stamping again, it can be selected not to heat, so the working temperature of the positioning groove and the stamping component in the stamping forming machine in the disclosure is 0-80° C. Of course, it can also be decided according to other factors, such as the type of adhesive component chosen.

This example utilizes wetting solution to sterilize and disinfect the upper half of the eyelashes during steam heating and, combined with the components of soaking solutions applied to the finished eyelashes, ensures greater comfort during wear for users, alleviating symptoms such as eye soreness, fatigue, and blurred vision.

Since the positioner in this example is bonded after high-temperature steam heating, it avoids the issue in existing artificial eyelash production methods where transparent glue on the positioner turns white due to high-temperature steam, affecting the quality of the made eyelash stems and making them opaque. This makes the produced eyelashes more transparent and aesthetically pleasing;

Similarly, since the positioner in this example is bonded after high-temperature steam heating, it also avoids the issue in existing artificial eyelash production methods where black glue on the positioner becomes sticky due to high-temperature steam, making it easy to stick to paper scraps when taken off the shaping tube, resulting in black stems of the made eyelashes having white paper scraps stuck on them, rendering them unwearable;

Moreover, since the positioner in this example is bonded to the eyelashes after being rolled by the shaping tube, it also avoids the issue in existing artificial eyelash production methods where the positioner glue becomes flat due to pressure from rolling, causing the positioner to widen and affect wearing comfort;

More specifically, the purpose of soaking solutions in this invention is to allow the positioner and curved eyelash surfaces to adhere to components of soaking solutions. Thus, during use, the artificial eyelashes not only possess their original functionality but can also address discomfort issues for certain users, such as discomfort in the eyes after wearing, which can be resolved through sodium hyaluronate solution adhering to the positioner and curved eyelash surfaces. This also broadens the user base for artificial eyelashes.

Embodiment 2, an artificial eyelash preparation device suitable for the aforementioned preparation method is disclosed. The device includes a lash extension separation mold, a stamping machine, a steam pot, a wiring board, and a glue applicator. The lash extension separation mold includes a mold body 1 and a mold cover 2. The front side of the mold body 1 is equipped with two loading slots 11. The top surface of the mold body 1 has a eyelash extension separation slot 12. The eyelash extension separation slot 12 penetrates through the corresponding loading slots 11. The rear side of the eyelash extension separation slot 12 is curved. The eyelash extension separation slot 12 is internally divided by eyelash extension separation piece 13 at intervals. Eyelash extension separation gaps 14 are formed between adjacent eyelash extension separation piece 13. The top surface of the mold body 1 has a strip-shaped bonding component slot 15. The bonding component slot 15 forms a 60-90 degrees cross angle with the eyelash extension separation piece 13. The loading slot 11 is slidingly and hermetically connected to a loading box 3. The loading box 3 is vertically penetrated by a placement slot 31. The cross-section of the placement slot 31 is identical to and corresponds with the position of the eyelash extension separation slot 12. The inner wall of the placement slot 31 is vertically and slidingly hermetically connected to a placement plate 4. The lower inner wall of the loading slot 11 is penetrated by an operating slot 16.

In this example, the vertical outer wall of the placement plate 4 is equipped with a recess 41. The recess 41 slidingly connects to a blocking piece 5. The blocking piece 5 is connected to the bottom of the recess 41 via a spring 43. The end of the blocking piece 5 far from the spring 43 is inclined upwards with a guide surface 51. The inner wall of the placement slot 31 vertically has several blocking slots 32. The opening of the blocking slot 32 matches the size of the recess 41. The recess 41 aligns with the corresponding blocking slot 32 as the placement plate 4 moves upwards. The end of the blocking piece 5 far from the spring 43 can be inserted into the corresponding blocking slot 32.

In this example, the blocking slots 32 are located on the side walls of the placement slot 31.

In this example, elastic sponges 33 are placed inside the blocking slots 32. The elastic sponges 33 can be pressed towards the bottom of the blocking slots 32 by the blocking piece 5. The elastic sponges 33 can fill the corresponding blocking slots 32 after the blocking piece 5 moves away.

Before using the lash extension separation mold to make single piece lash extensions, the operator should first slide out the loading box 3 from the loading slot 11, then place the lash extensions into the placement slot 31, with the length direction of the lash extensions consistent with the front-back direction of the loading box 3. The lash extensions will fall onto the top surface of the placement plate 4. Since the blocking slots 32 are located on the side of the placement slot 31, the ends of the lash extensions will not get stuck in the blocking slots 32. Also, since elastic sponges 33 are placed inside the blocking slots 32, they further prevent the lash extensions from getting stuck in the blocking slots 32. After placing the lash extensions at the lower part of the placement slot 31, push the loading box 3 to slide into the loading slot 11. After the loading box 3 is fully entered into the loading slot 11, the vertically penetrating placement slot 31 aligns with the eyelash extension separation slot 12, completing the loading process of the lash extensions;

Next, the operator should cover the mold cover 2 on the side of the eyelash extension separation slot 12 of the mold body 1, covering the mouth of the eyelash extension separation slot 12 with the mold cover 2. Then, control the mold body 1 to tilt upside down, placing the mold cover 2 below the mold body 1 while keeping the mold body 1 in a tilted state, i.e., with the opening of the loading slot 11 tilted upwards. As the mold body 1 shakes against the workbench with the mold cover 2, the lash extensions inside the placement slot 31 will enter into the eyelash extension separation slot 12 along the placement slot 31. Since there are several eyelash extension separation piece 13 inside the eyelash extension separation slot 12, they can evenly separate the lash extensions entering into the eyelash extension separation slot 12, allowing them to enter into the eyelash extension separation gaps 14. To ensure that the lash extensions more fully and evenly enter into the eyelash extension separation slot 12, shake the mold body 1 slightly while it is upside down. Since the curved inner wall of the eyelash extension separation slot 12 is at the lower position, the lash extensions will press against the curved inner wall of the eyelash extension separation slot 12 under shaking, completing the fur-separating process of the lash extensions.

Subsequently, the operator should manually access through the operating slot 16 to touch the placement plate 4. Under manual pressure, the placement plate 4 moves closer to the eyelash extension separation slot 12 along the placement slot 31, sliding. The recess 41 moves away from the original blocking slot 32 as the placement plate 4 moves, causing the end of the blocking piece 5 far from the spring 43 to retract into the recess 41 for clearance under the original blocking slot 32 opening. The elastic sponges 33 inside the original blocking slot 32 restore and fill the original blocking slot 32 after the blocking piece 5 moves away. After pressing the placement plate 4 to its limit position, stop its movement. The recess 41 aligns with a new blocking slot 32 as the placement plate 4 moves, and under the spring force of the spring 43, the blocking piece 5 enters into the new blocking slot 32, pressing flat the elastic sponges 33 inside the blocking slot 32. This completes the locking of the placement plate 4, i.e., locking the lash extensions inside the eyelash extension separation slot 12.

Finally, contacting the mold body 1 upright with the opening of the eyelash extension separation slot 12 facing vertically upwards and move the mold cover 2 away from the top surface of the mold body 1. Cut off the bonding component falling on the top surface of the mold body 1. To ensure that the bonding component forms a 70-degree cross angle with the lash extensions, place it directly above the bonding component slot 15. Control the mold body 1 to complete one cycle of tilting upside down and righting up before tearing off the bonding component from the top surface of the mold body 1. The bonding component will carry away the lash extensions that came into contact with it at the upper port of the eyelash extension separation gaps 14, forming a single piece lash extension;

Repeating the above actions to obtain another single piece lash extension. After using up the lash extensions inside the placement slot 31, slide out the loading box 3 from the loading slot 11 again, push up the placement plate 4 from the upper port of the placement slot 31 to remove it, and then re-enter it from the lower port of the placement slot 31 to add more lash extensions.

This example accomplishes separating and entering into eyelash extension separation gaps 14 by placing lash extensions into the placement slot 31 aligned with the eyelash extension separation slot 12 during tilting upside down of the mold body 1, preparing for subsequent bonding component pickup of lash extensions. Compared to existing methods of manually adding and placing lash extensions into eyelash extension separation slots one by one, this significantly improves the efficiency of making single piece lash extensions and facilitates usage.

Embodiment 3: The upper surface of the loading box 3 is fixedly connected to a hemispherical elastic protrusion 34. The upper wall of the loading groove 11 is provided with a corresponding pit 17 for the elastic protrusion 34. As the loading box 3 enters the loading groove 11, the elastic protrusion 34 snaps into the pit 17. The front side of the loading box 3 is fixedly connected to a handle.

In this embodiment, the lower wall of the slot 41 is perforated downwards by a slot 42. The slot 42 is movably connected to a middle block 44. The cross-sectional shape of the middle block 44 is L-shaped. The upper end of the middle block 44 is fixedly connected to the locking block 5.

After the loading box 3 slides into the loading groove 11 along its opening, the elastic protrusion 34 on the upper surface of the loading box 3 gets compressed. To avoid damage to the elastic protrusion 34, the position of the elastic protrusion 34 on the upper surface of the mold body 1 can also be recessed. As the loading box 3 enters the loading groove 11, the elastic protrusion 34 snaps into the pit 17, locking the loading box 3 and preventing it from sliding out of the loading groove 11 during use, thereby enhancing the stability of the eyelash mold.

As the eyelash extensions in the placement slot 31 are consumed, the placement plate 4 gradually approaches the combing groove 12. After reaching the limit position near the combing groove 12, additional eyelash extensions need to be added to the placement slot 31. To prevent remaining eyelash extensions from getting stuck, operators should preemptively move the middle block 44 by passing through the operating slot 16, which moves the locking block 5 from the locking slot 32 back into the slot 41, unlocking the placement plate 4. Then, pulling the middle block 44 moves the placement plate 4 away from the combing groove 12, enlarging the space above the placement slot 31 of the placement plate 4. The mold body 1 is then placed down for impact, causing the eyelash extensions in the combing groove 12 to fall back into the placement slot 31 and onto the upper surface of the placement plate 4. Subsequently, the loading box 3 is pulled out by controlling the handle, and after the elastic protrusion 34 is removed from the pit 17 and flattened, eyelash extensions can be added. By expanding the space in the placement slot 31 before removing the loading box 3, eyelash extensions from the combing groove 12 are collected back into the placement slot 31, preventing bending and sticking of eyelash extensions after the loading box 3 is removed from the transfer box, and also preventing eyelash extensions falling into the loading groove 11 after the loading box 3 is removed from the loading groove 11.

In this embodiment, before the loading box 3 enters the loading groove 11, the middle block 44 does not extend beyond the lower port of the placement slot 31, allowing the loading box 3 to smoothly enter the loading groove 11.

Embodiment 4: The side of the mold body 1 is provided with a sliding rail 18. The mold cover 2 is slidably connected to the sliding rail 18 via its edge strip 21. The lower surface of the mold cover 2 contacts the upper surface of the mold body 1.

In this embodiment, the lower surface of the mold cover 2 is provided with a clearance slot 22. The clearance slot 22 penetrates through the front side of the mold cover 2. The rear inner wall of the clearance slot 22 is fixedly connected to an elastic piece 23. The shape of the elastic piece 23 is L-shaped. The elastic piece 23 extends towards the front side and covers the front side of the clearance slot 22. The upper end of the elastic piece 23 is fixedly connected to a catch block 24. In the initial state, the lower surface of the elastic piece 23 contacts the upper surface of the mold body 1.

Before controlling the eyelash extensions in the placement slot 31 to enter the combing groove 12, operators first move the mold cover 2 to slide along the sliding rail 18, thus covering the upper opening of the combing groove 12 with the mold cover 2. Then, tilting and inverting the mold body 1 allows eyelash extensions in the placement slot 31 to enter the combing gap 14. After controlling the placement plate 4 to approach and be locked near the combing groove 12, the mold body 1 is placed upright again. Then, catching and lifting the catch block 24 causes the front part of the elastic piece 23 to flip upwards around its rear part, moving into the clearance slot 22 for clearance. After flipping upwards, the elastic piece 23 disengages from contact with the mold body 1 and the combing piece 13. Then, moving the mold cover 2 backwards without taking away the eyelash extensions in the combing gap 14, and ensuring that the mold cover 2 does not disengage from the mold body 1 while keeping the combing groove 12 fully exposed. After releasing the catch block 24, the elastic piece 23 resets and presses against the mold body 1, preventing the mold cover 2 from shaking due to its tight fit and achieving precise positioning of the mold cover 2. Subsequently, after adhering with an adhesive in the adhesive slot 15 directly above, inverting and placing the mold body 1 upright once, and peeling off the adhesive creates an eyelash fiber sheet. Then, while keeping pressure on the catch block 24, the elastic piece 23 is pressed into contact with the upper surface of the mold body 1, and moving the elastic piece 23 and mold cover 2 forward pushes away excess eyelash extensions on the upper surface of the mold body 1, ensuring cleanliness. After moving forward, the elastic piece 23 and mold cover 2 cover the combing groove 12, release the catch block 24, and the mold cover 2 locks onto the upper surface of the mold body 1 again. By repeating these actions, pressing the elastic piece 23 during forward movement of the mold cover 2 removes excess eyelash extensions, avoiding residual eyelash extensions affecting subsequent eyelash fiber sheet quality. Additionally, lifting the elastic piece 23 during backward movement of the mold cover 2 prevents eyelash extensions in the combing gap 14 from being taken away, ensuring integrity of eyelash extensions in the combing gap 14 and further improving eyelash fiber sheet quality. Finally, the elastic piece 23 also serves to position the mold cover 2, allowing it to lock at any time after moving on the mold body 1, preventing shaking and enhancing stability of the eyelash mold usage.

Embodiment 5: Artificial eyelashes obtained from a preparation device and preparation method.

Figure 5:
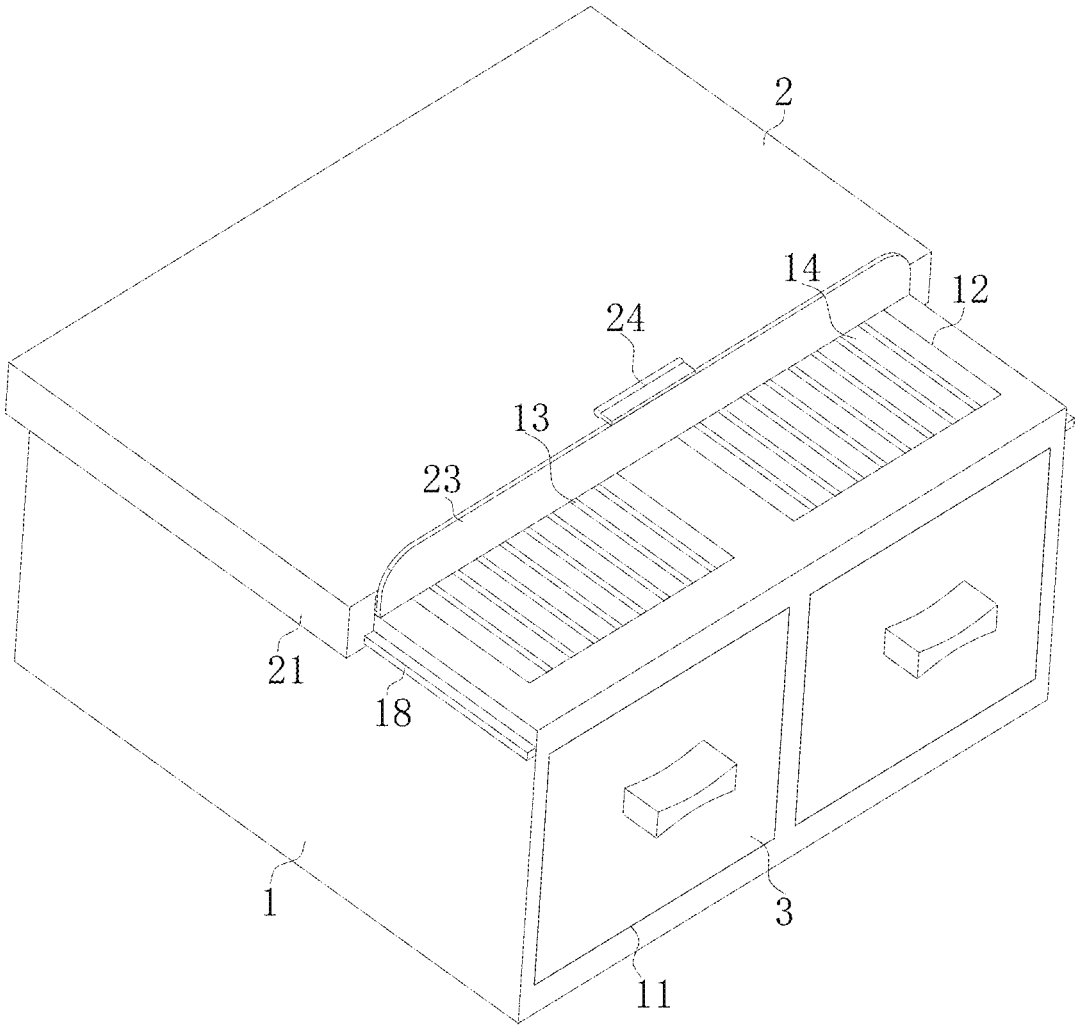
FIG. 5 is a perspective view of the eyelash separation mold in the preparation device of the disclosure.
Figure 6:
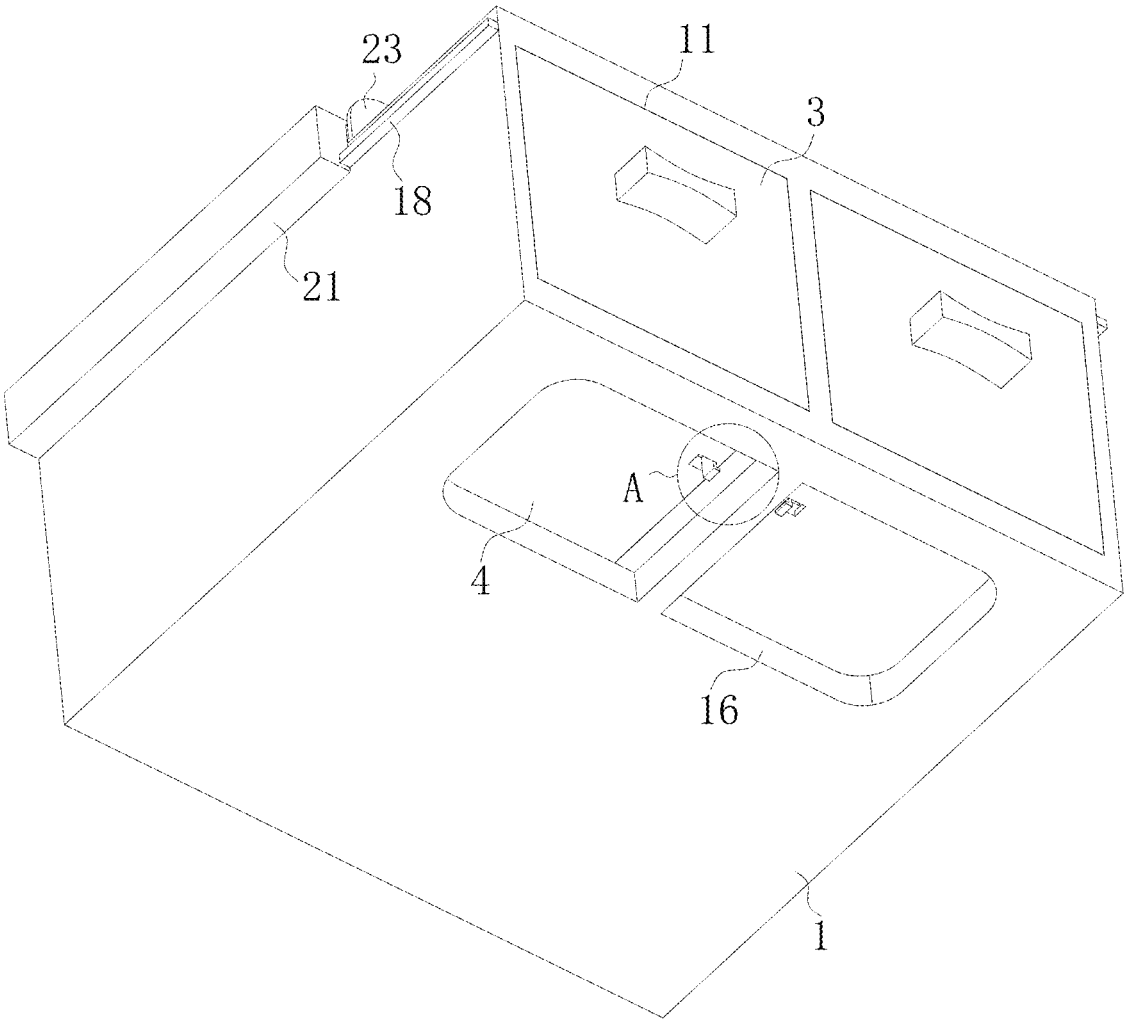
FIG. 6 is a perspective view from another angle of FIG. 5.
Figure 7:
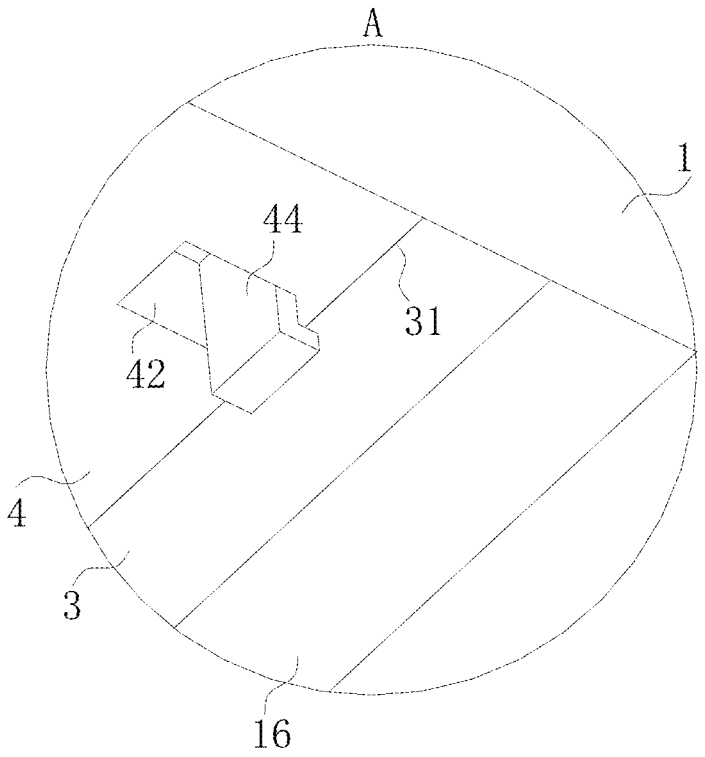
FIG. 7 is an enlarged view of area A in FIG. 6.
Figure 8:
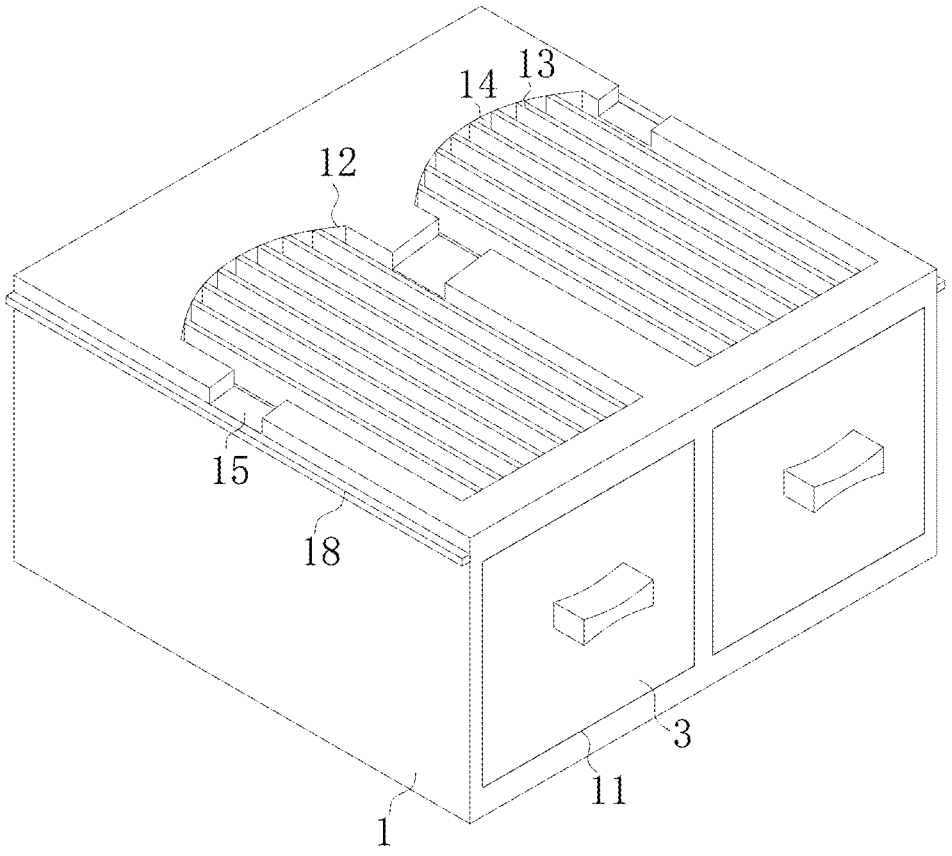
FIG. 8 is a perspective view of the mold body in the disclosure.
Figure 9:
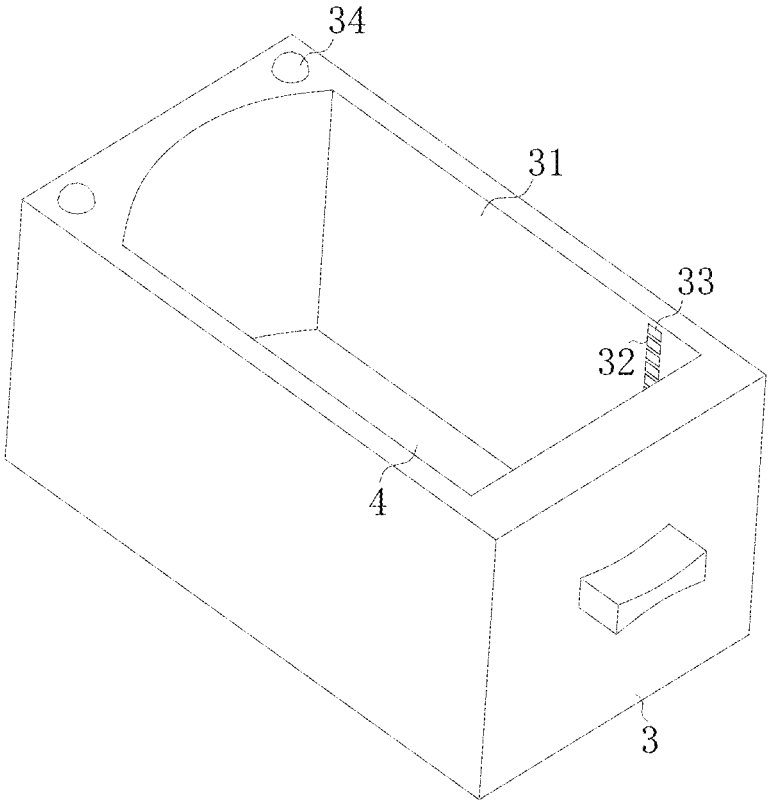
FIG. 9 is a perspective view of the loading box in the disclosure.
Figure 10:
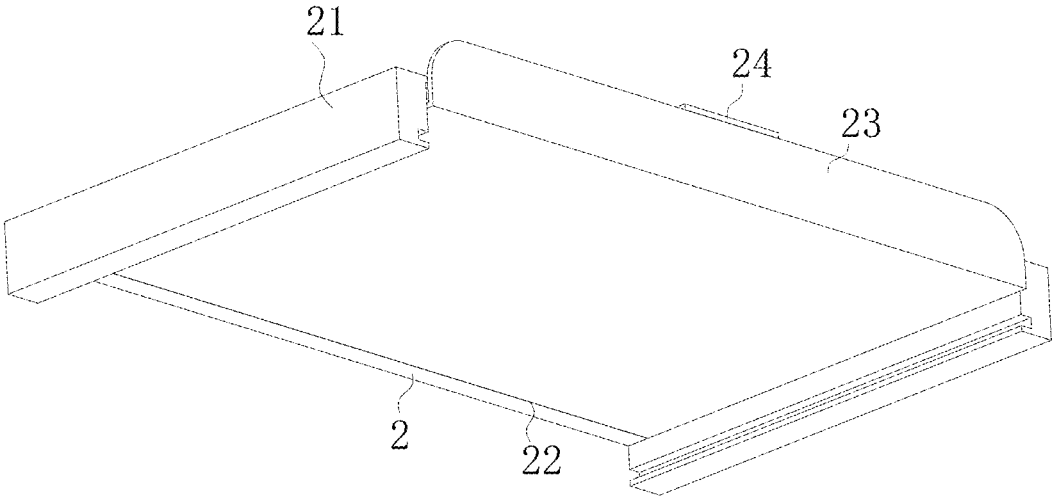
FIG. 10 is a perspective view of the mold cover in the disclosure.
Figure 11:
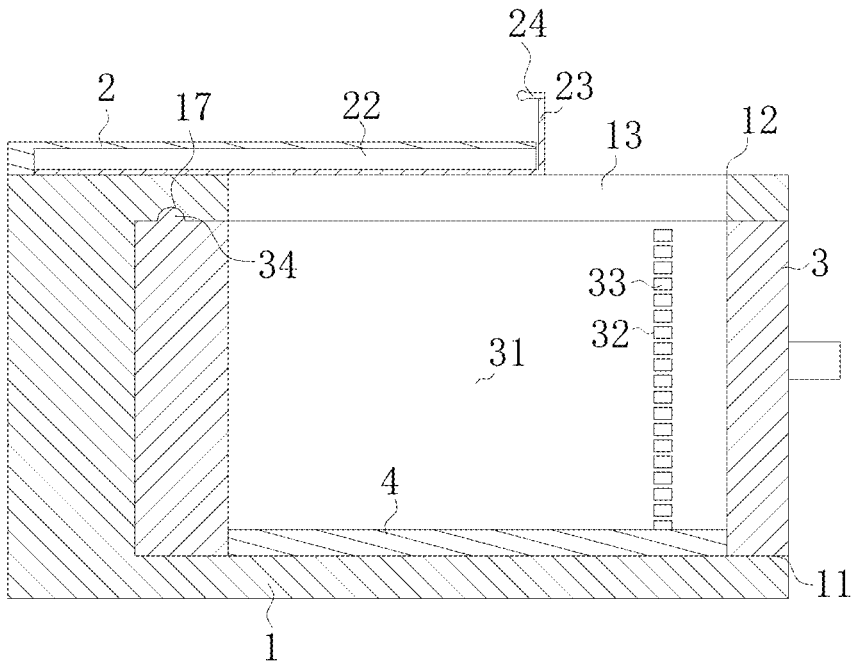
FIG. 11 is a location diagram of the pit in the disclosure.
Figure 12:
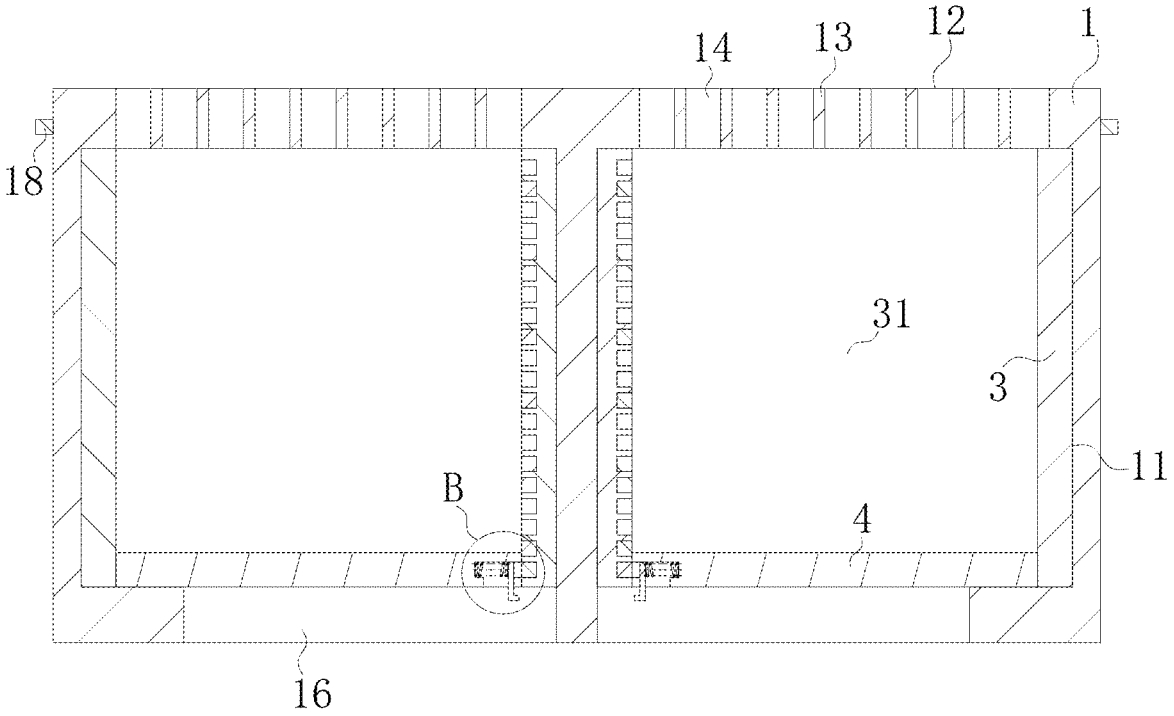
FIG. 12 is a cross-sectional view of the mold body.
Figure 13:
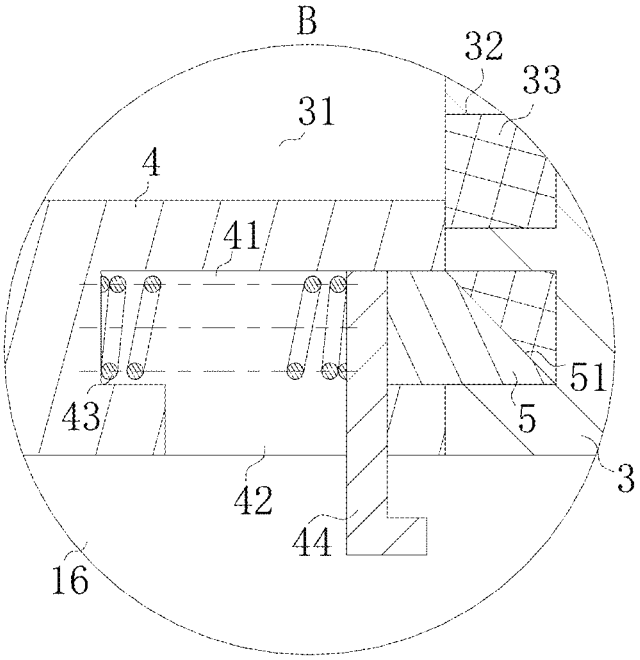
FIG. 13 is an enlarged view of area B in FIG. 12.

In this description of the invention, it should be noted that terms such as "center", "longitudinal", "transverse", "up", "down", "front", "rear", "left", "right", "vertical", "horizontal", "top", "bottom", "inner", "outer" and other orientations or positional relationships are based on the orientation or positional relationship shown in FIG. 5, only to facilitate describing the invention and simplifying the description, rather than indicating or implying that the device or component referred must have a specific orientation, constructed or operated in a specific orientation. Therefore, it cannot be understood as a limitation to the scope of protection of the invention. Moreover, terms like "first", "second", "third" etc. are only used to distinguish descriptions, and cannot be understood as indicating or implying relative importance.

I claim:

1. A method for preparing an artificial eyelash, comprising:

S1: adhering lash extensions on a lash extension separation mold with an adhesive component to obtain single piece of eyelash;

S2: bonding a plurality of single pieces of eyelash through adhesive tapes to form a semi-finished eyelash product;

S3: cutting off the semi-finished eyelash product near a lower edge of the adhesive component by a cutting tool, while retaining an upper half of eyelashes on the semi-finished eyelash product with the adhesive component;

S4: initially forming tips of the upper half of the eyelashes by a stamping machine to obtain the upper half of the eyelashes with curved tips;

S5: laying waterproof paper flat on a workbench, laying the upper half of the eyelashes with curved tips flat on a surface of the waterproof paper, wrapping the waterproof paper and the upper half of the eyelashes with a shaping tube, and fixing the waterproof paper wrapped on a surface of the shaping tube by a fixing rope to obtain a shaping component with the upper half of the eyelashes wrapped between the waterproof paper and the shaping tube;

S6: heating the shaping component in a steam pot, opening the steam pot and removing the shaping component to obtain curved eyelashes;

S7: soaking the curved eyelashes in a first soaking solution and removing, applying adhesive on positions at both sides of the curved eyelashes near the adhesive component and along a length direction of the adhesive component;

S8: drying the curved eyelashes in a ventilated room temperature environment, cutting the curved eyelashes with a blade along the positions of the applied adhesive to obtain a final eyelash, sealing and packaging the final eyelash.

2. The method of claim 1, wherein an intersection angle between the length direction of the adhesive component in the S1 and a length direction of the lash extensions is within 0-180 degrees without including end points.

3. The method of claim 1, wherein in the S2, the lash extensions on two adjacent single pieces of eyelash are in cross contact, and tilting directions of the lash extensions on the two adjacent single pieces of eyelash are opposite.

4. The method of claim 1, wherein a number of the single pieces of eyelash in the semi-finished eyelash product in S2 is at least two.

5. The method of claim 1, wherein a stamping temperature in the S4 is within a range of 0-80 degrees Celsius without including end point 0, a stamping time is within 3-6 seconds, and a stamping force is within 5-10 Newtons (N).

6. The method of claim 1, wherein the waterproof paper in the S5 is moistened with a wetting solution before being laid flat on the workbench.

7. The method of claim 6, wherein one edge of the waterproof paper is dry, and a remaining part of the waterproof paper is wet.

8. The method of claim 6, wherein the wetting solution is a 0.9% sodium chloride solution.

9. The method of claim 7, wherein the shaping tube curls from the dry edge of the waterproof paper; and the curved tips of the upper eyelashes are arranged away from the dry edge of the waterproof paper.

10. The method of claim 1, wherein the fixing rope in S5 comprises a rubber band and an elastic rope.

11. The method of claim 1, wherein the shaping component in the S6 is wrapped and sealed with a plastic bag before being placed in the steam pot.

12. The method of claim 1, wherein an operating temperature of the steam pot in the S6 is 60-78 degrees Celsius, and an operating time is 14-16 minutes.

13. The method of claim 1, wherein the positions of the applied adhesive at both sides of the curved eyelashes in S7 are 2 mm away from the adhesive component, forming a locator-free eyelash.

14. The method of claim 1, wherein after placing two locators on both sides of the curved eyelashes in the S7, the two locators are bonded to the curved eyelashes by the adhesive to form a double-locator eyelash.

15. The method of claim 1, wherein after placing a locator on one side of the curved eyelashes in the S7, the locator is bonded to the curved eyelashes by an adhesive to form a single-locator eyelash.

16. The method of claim 14, wherein the locators is soaked in a second soaking solution before use.

17. The method of claim 1, wherein the first soaking solution is at least one of VE solution and sodium hyaluronate solution.

18. The method of claim 16, wherein the second soaking solution is at least one of VE solution and sodium hyaluronate solution.

19. The method of claim 17, wherein a soaking time of the curved eyelashes in the first soaking solution is 6-12 hours, and a soaking temperature is 3-5 degrees Celsius.

20. The method of claim 18, wherein the locators are soaked in the second soaking solution for 6-12 hours and a soaking temperature is 15-30 degrees Celsius.

21. The method of claim 14, when bonding the curved eyelashes to the locators with the adhesive, further comprising:

A: hanging a first locator on a wiring board, placing the curved eyelashes above the first locator, and controlling a position of the first locator to be 2 mm away from an upper edge of the adhesive component;

B: placing a second locator above the curved eyelashes such that the two locators are distributed on both sides of the curved eyelashes, and a distance between the first locator and the second locator is 0.01-0.5 mm;

C: evenly applying glue between the first locator and the second locator by a glue applicator, and applying the adhesive on both sides of the curved eyelashes to obtain the double-locator eyelash.

22. The method of claim 15, when bonding the curved eyelashes to the locator with the adhesive, further comprising:

a: hanging the locator on a wiring board, place the curved eyelashes above the locator, and controlling a position of the locator to be 2 mm away from an upper edge of the adhesive component;

b: applying glue evenly onto the locator by a glue applicator, and applying the adhesive on both sides of the curved eyelashes to obtain the single-locator eyelash.

23. The method of claim 14, wherein the locators are colorless or colored.

24. The method of claim 1, wherein a drying time in the S8 is 5-7 days, and during the drying, the curved eyelashes are sprayed with the first soaking solution.

25. The method of claim 16, wherein the locators are sprayed with second soaking solution during the drying of the curved eyelashes.

* * * * *